US005814776A

United States Patent [19]

Worley

[11] Patent Number: 5,814,776

[45] Date of Patent: Sep. 29, 1998

[54] APPLIANCE TIMER HAVING COUPLING MECHANISM THAT PREVENTS CAMSTACK FROM ROTATING IN INAPPROPRIATE DIRECTION

[75] Inventor: Lloyd C. Worley, Hendricks County, Ind.

[73] Assignee: Emerson Electric Co., St. Louis, Mo.

[21] Appl. No.: 807,350

[22] Filed: Feb. 27, 1997

[51] Int. Cl.[6] ..... H01H 43/00; G04F 8/00

[52] U.S. Cl. ..... 200/38 R; 200/38 A; 368/107

[58] Field of Search ..... 200/11 R, 14, 200/11 A–11 TW, 17 R, 30 R, 33 R, 36, 37 R, 37 A, 38 R–38 DA, 35 H, 35 A, 35 W, 564, 573, 336; 368/107–114

[56] References Cited

U.S. PATENT DOCUMENTS

| | | | |
|---|---|---|---|
| 3,288,950 | 11/1966 | Ashman | 200/18 |
| 3,329,780 | 7/1967 | Gratrix, Sr. | 200/38 |
| 3,476,892 | 11/1969 | Simmons et al. | 200/38 |
| 3,699,277 | 10/1972 | Straub | 200/38 R |
| 4,339,962 | 7/1982 | Babel | 74/335 |
| 4,348,560 | 9/1982 | Ray et al. | 200/38 A |
| 4,381,431 | 4/1983 | Ritzenthaler et al. | 200/38 R |
| 4,525,609 | 6/1985 | Matsumoto et al. | 200/38 R |
| 4,536,627 | 8/1985 | Duve | 200/38 R |
| 4,595,808 | 6/1986 | Antonuzzi et al. | 200/37 R |
| 4,649,239 | 3/1987 | Duve | 200/38 R |
| 4,811,312 | 3/1989 | Cole | 368/107 |
| 5,193,078 | 3/1993 | Zink et al. | 368/107 |
| 5,220,542 | 6/1993 | Zink et al. | 368/107 |
| 5,298,700 | 3/1994 | Champagne et al. | 200/30 R |
| 5,400,302 | 3/1995 | Yamamoto et al. | 368/107 |

*Primary Examiner*—Michael A. Friedhofer
*Attorney, Agent, or Firm*—Mark D. Becker

[57] ABSTRACT

An appliance timer includes a cam member and a first coupler attached to the cam member, the first coupler having a structure with a notch defined therein, wherein the structure defines a substantially cylindrical member having a void defined therein. The appliance timer also includes a knob shaft and a second coupler attached to the knob shaft and positioned within the void, wherein (1) the second coupler includes a body and a tab, (2) the tab is movable in relation to the body, (3) the body is fixed in relation to the knob shaft, and (4) the tab is positionable within the notch.

20 Claims, 6 Drawing Sheets

APPLIANCE TIMER HAVING COUPLING MECHANISM THAT PREVENTS CAMSTACK FROM ROTATING IN INAPPROPRIATE DIRECTION

BACKGROUND OF THE INVENTION

The present invention generally relates to appliance timers, and more specifically to an appliance timer having a coupling mechanism that prevents the camstack from rotating in an inappropriate direction.

Appliance timers are commonly used in many household appliances, such as dishwashers. Appliance timers typically include a knob fixed on a knob shaft which supports the knob during rotation thereof. Appliance timers also include a number of program blades attached to the camstack. Appliance timers further include a drive mechanism for rotating the camstack during operation of the household appliance. The program blades cooperate with a number of cam followers and switches to control work operations of the appliance. For example, appliance timers similar to the ones described above can be used to start and stop a wash cycle in a dish washer.

During use of the household appliance an operator may select a specific work operation by rotating the knob of the appliance timer in an appropriate direction to a specific location. Rotation of the knob also rotates the camstack and the program blades in the appropriate direction to a specific location. As a result, the camstack and the program blades are positioned to electrically initiate the desired work operation via the cooperating cam followers and switches. For example, the camstack can be rotated (via the knob) to a position that initiates a wash cycle followed by a rinse cycle in a dishwasher.

One problem with the above described appliance timers is that they are generally subject to damage if rotated in an inappropriate direction. Specifically, if the knob (and thus the camstack) is rotated in a direction opposite to its appropriate direction, serious damage to the appliance timer's program blades, cam followers, drive mechanism and switches may occur.

One approach to solving the aforementioned problem is to provide a stop post or tang in the appliance timer mechanically coupled to the knob in an attempt to eliminate any improper rotation by the knob and thus the camstack. However, one disadvantage to this approach is that if enough force is applied to the knob in the inappropriate direction, the stop post can be broken or overcome, thus allowing the camstack to rotate in the inappropriate direction, which results in the above described damage. Moreover, even if the stop post does not break or is not overcome, the knob itself can be damaged if enough force is applied in the inappropriate direction. Replacing a damaged knob is expensive and is an inconvenience for the operator.

Other approaches to solving the aforementioned problem involve utilizing various knob shaft clutch mechanisms. However, these clutch mechanisms tend to be relatively mechanically complex which increases their cost.

It would therefore be desirable to provide an appliance timer having an inexpensive coupling mechanism that prevents a camstack from rotating in an inappropriate direction. It would also be desirable to provide an appliance timer having a coupling mechanism that prevents a camstack from rotating in an inappropriate direction regardless of how much force is applied to the timer knob. It would further be desirable to provide an appliance timer having a coupling mechanism that prevents damage to the appliance knob when rotated in an inappropriate direction.

SUMMARY OF THE INVENTION

In accordance with one embodiment of the present invention, there is provided an appliance timer including a knob shaft and a camstack having a program blade attached thereto. The appliance timer also includes a coupling mechanism which connects the knob shaft to the camstack, wherein the coupling mechanism includes (1) a first coupler having a structure with a notch defined therein, and (2) a second coupler having a body and a tab which is movable in relation to the body, the tab being positionable within the notch.

In accordance with another embodiment of the present invention, there is provided an appliance timer including a cam member and a first coupler attached to the cam member, the first coupler having a structure with a notch defined therein, wherein the structure defines a substantially cylindrical member having a void defined therein. The appliance timer also includes a knob shaft and a second coupler attached to the knob shaft and positioned within the void, wherein (1) the second coupler includes a body and a tab, (2) the tab is movable in relation to the body, (3) the body is fixed in relation to the knob shaft, and (4) the tab is positionable within the notch.

In accordance with yet another embodiment of the present invention there is provided a coupling apparatus which includes a first member and a first coupler attached to the first member, the first coupler having a structure with a notch defined therein, wherein the structure defines a substantially cylindrical member having a void defined therein. The coupling apparatus also includes a second member and a second coupler attached to the second member and positioned within the void, wherein (1) the second coupler includes a body and a tab, (2) the tab is movable in relation to the body, (3) the body is fixed in relation to the second member, and (4) the tab is positionable within the notch.

It is therefore an object of the present invention to provide a new and useful appliance timer.

It is another object of the present invention to provide an improved appliance timer.

It is another object of the present invention to provide a new and useful coupling apparatus.

It is still another object of the present invention to provide an improved coupling apparatus.

It is yet another object of the present invention to provide an appliance timer having an inexpensive coupling mechanism that prevents a camstack from rotating in an inappropriate direction.

It is yet another object of the present invention to provide an appliance timer having a coupling mechanism that prevents a camstack from rotating in an inappropriate direction regardless of how much force is applied to the timer knob.

It is still another object of the present invention to provide an appliance timer having a coupling mechanism that prevents damage to the appliance knob when rotated in an inappropriate direction.

The above and other objects, features, and advantages of the present invention will become apparent from the following description and attached drawings.

Detailed Description of the Preferred Embodiments

Figure 1:
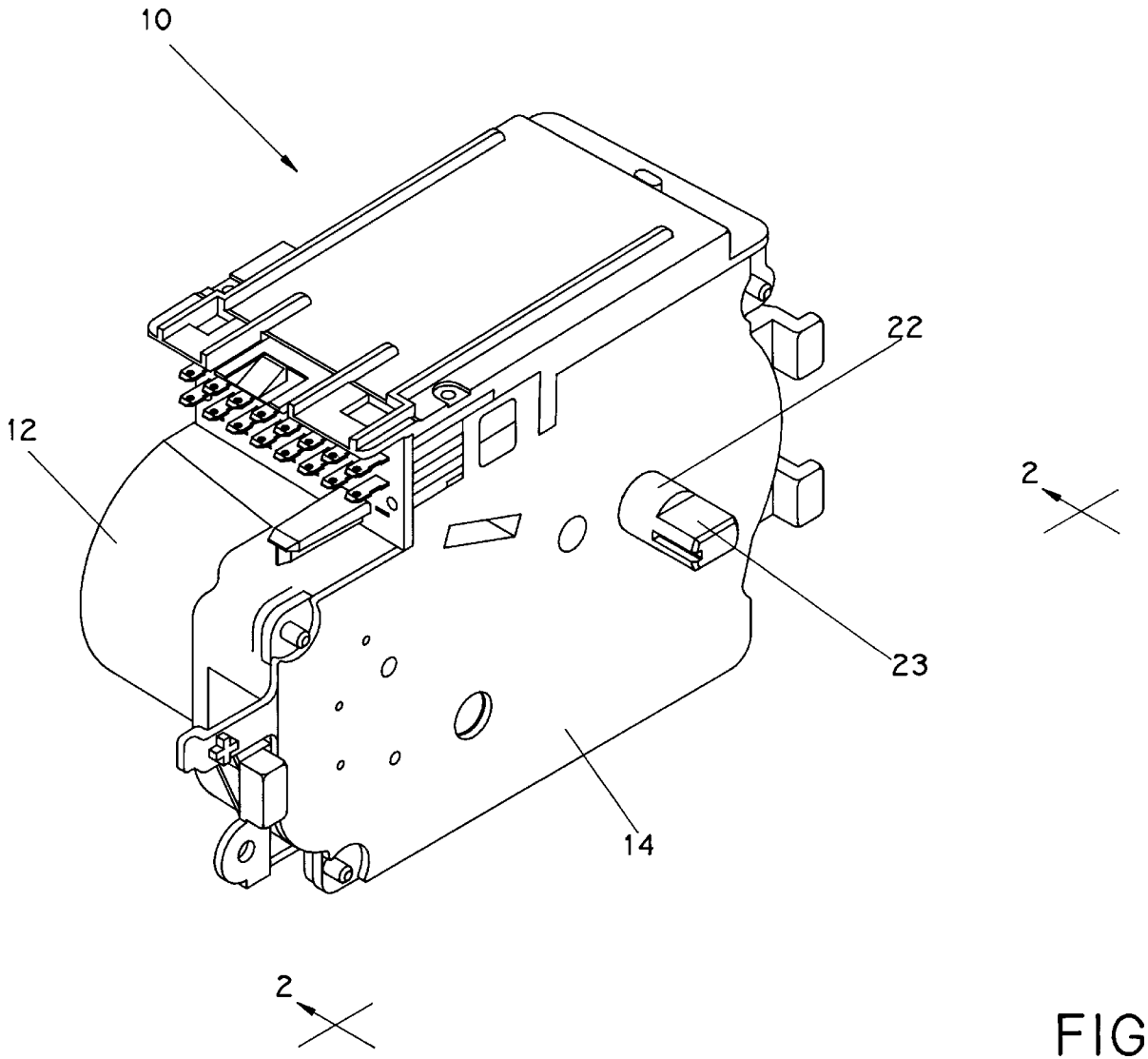
FIG. 1 is a perspective view of an appliance timer which incorporates the features of the present invention therein.

While the invention is susceptible to various modifications and alternative forms, specific embodiments thereof have been shown by way of example in the drawings and will herein be described in detail. It should be understood, however, that there is no intent to limit the invention to the particular form disclosed, but on the contrary, the intention is to cover all modifications, equivalents, and alternatives falling within the spirit and scope of the invention as defined by the appended claims.

Figure 2:
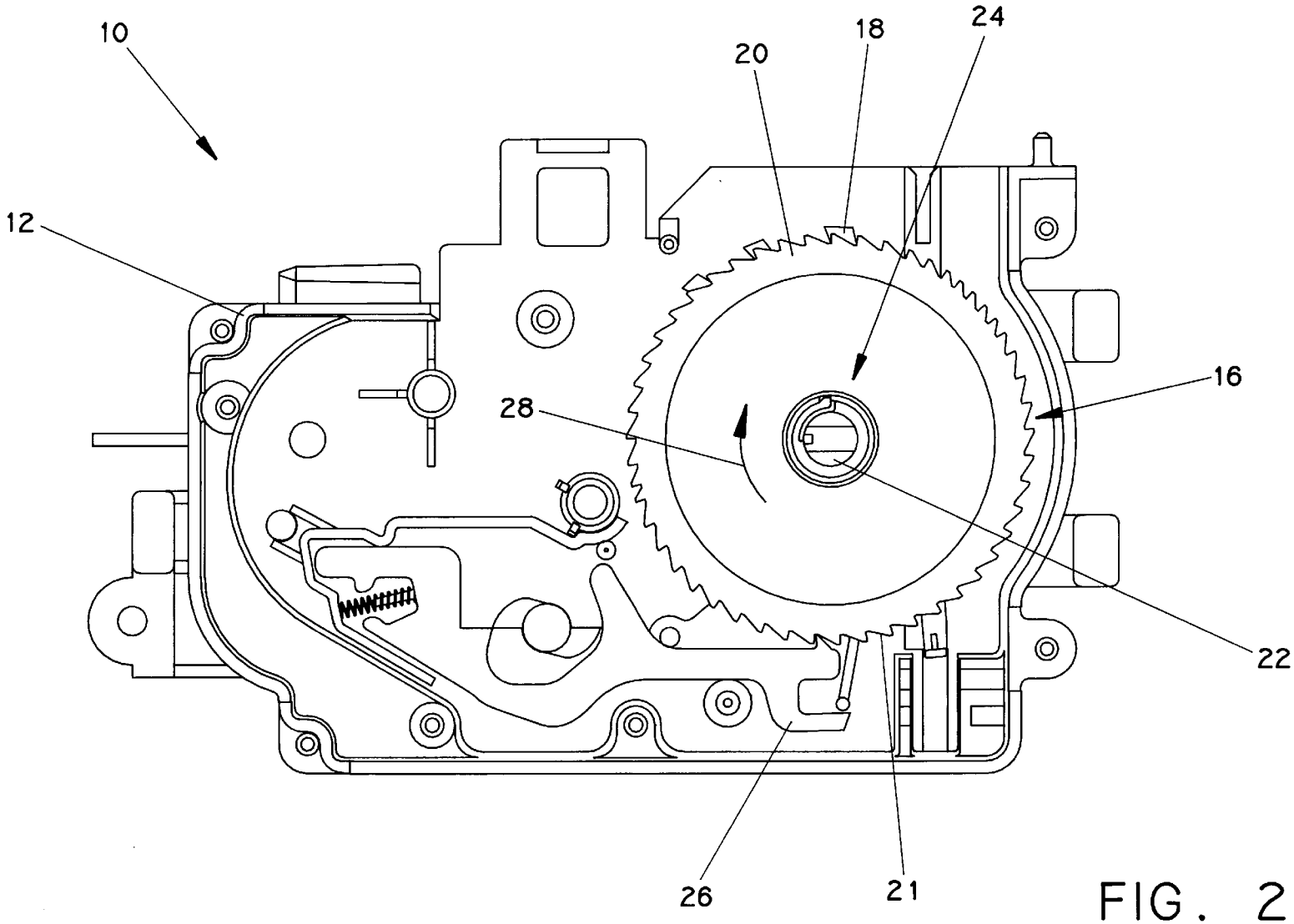
FIG. 2 is an elevational view taken along line 2—2 of FIG. 1 as viewed in the direction of the arrows with the plate removed for clarity of description.

Referring now to FIGS. 1 and 2, there is shown an appliance timer 10. Appliance timer 10 controls various work operations associated with a given household appliance (not shown). Examples of such work operations include agitation, washing, spinning, drying, dispensing detergent, hot water filling, cold water filling and draining. The appliance timer 10 includes a housing 12, a plate 14 (note that in FIG. 2 plate 14 has been removed for clarity of description), a camstack 16 having a program blade 18 attached thereto, a knob shaft 22, a drive pawl 26 and a coupling mechanism 24 (note that only a portion of program blade 18 is shown for clarity of description).

Plate 14 is attached to housing 12. Knob shaft 22 is connected to camstack 16 via coupling mechanism 24. Knob shaft 22, camstack 16 and coupling mechanism 24 are positioned within housing 12 such that a segment of knob shaft 22 having a keyed portion 23 defined thereon extends through plate 14 (see FIG. 1).

Keyed portion 23 is adapted to fit into a receptacle defined in a knob (not shown) thereby securing the knob to the knob shaft 22. Once the knob is secured to knob shaft 22, an operator of the household appliance may set the appliance timer 10 to a desired setting by manipulating the knob. Specifically, the operator may rotate the knob in a direction indicated by arrow 28 (see FIG. 2). Rotation of the knob also rotates camstack 16 and program blade 18 in the direction indicated by arrow 28. As a result, camstack 16 and program blade 18 can be rotated to an appropriate position to electrically initiate a desired work operation of the household appliance via a number of cooperating cam followers (not shown) and switches (not shown). For example, camstack 16 can be rotated to a position that initiates a wash cycle followed by a rinse cycle in a dishwasher.

Camstack 16 includes a drive blade 20 having a number ratchet teeth 21 formed thereon. The ratchet teeth 21 cooperate with a drive pawl 26 in order to rotate camstack 16. The program blade 18 cooperates with the cam followers (not shown) and switches (not shown) to selectively generate control signals as the camstack 16 rotates to control the work operations of the household appliance.

It should be understood that, while it is proper to rotate camstack 16 in the direction indicated by arrow 28 (i.e. an appropriate direction), appliance timer 10 is not designed to allow rotation of camstack 16 in a direction opposite to the direction indicated by arrow 28 (i.e. an inappropriate direction). Therefore, the appliance timer 10 is designed so that rotation of the camstack 16 in a direction opposite to the direction indicated by arrow 28 is resisted. However, if enough force is applied to camstack 16 in a direction opposite to the direction indicated by arrow 28, significant damage to the program blade 18, ratchet teeth 21 and/or drive pawl 26 can result. Damage to the aforementioned elements of appliance timer 10 may result in improper operation of the appliance timer.

Figure 3:
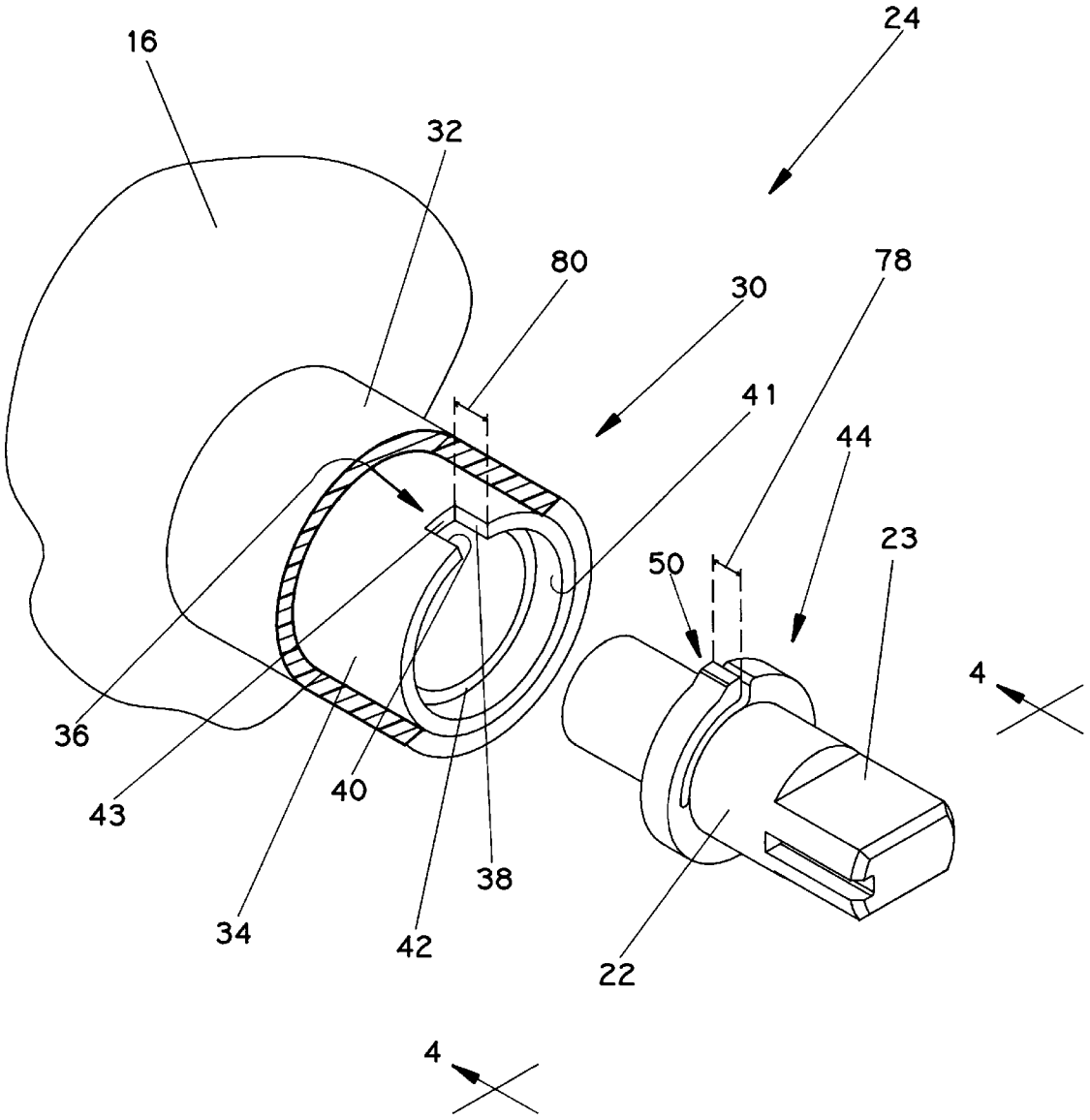
FIG. 3 is a fragmentary perspective exploded view of the coupling mechanism of FIG. 2.

FIG. 3 shows the coupling mechanism 24 in more detail. Coupling mechanism 24 includes a first coupler 30 and a second coupler 44. First coupler 30 includes an outer cylindrical structure 32 and an inner cylindrical structure 34 nested within outer cylindrical structure 32. Inner cylindrical structure 34 is fixed in relation to outer cylindrical structure 32. Both outer cylindrical structure 32 and inner cylindrical structure 34 are fixed in relation to camstack 16. First coupler 30 is made of a plastic material. Preferably, the plastic material is glass fiber reinforced polypropylene.

Inner cylindrical structure 34 defines a void 41. A bearing surface 42 provided within the void 41. Inner cylindrical structure 34 also has a notch 36 defined therein. Notch 36 is defined by a sidewall 38, a sidewall 40 and a sidewall 43.

Figure 4:
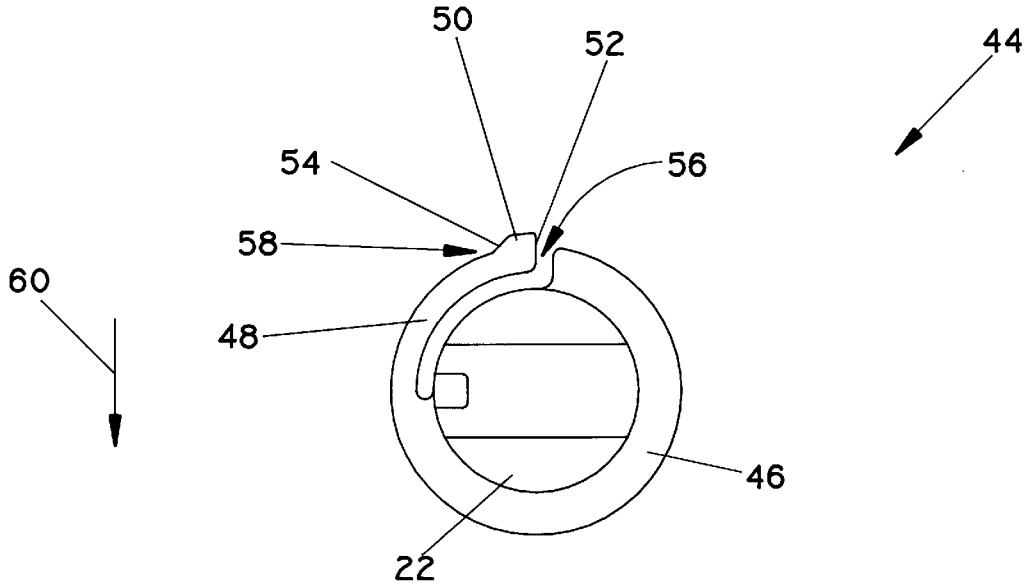
FIG. 4 is an enlarged front elevational view of the second coupler taken along line 4—4 of FIG. 3 as viewed in the direction of the arrows.
Figure 4A:
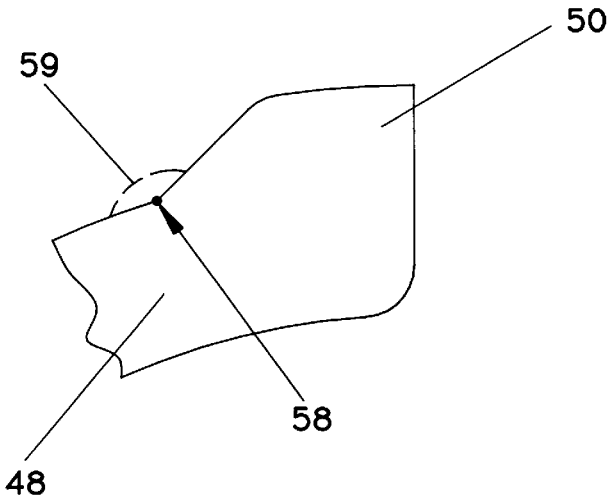
FIG. 4*a* is an enlarged fragmentary side elevational view of the tab portion of the arm of the second coupling member of FIG. 4.

As shown in more detail in FIG. 4, second coupler 44 includes a C-shaped body 46, an arm 48 and a tab 50. C-shaped body 46 partially surrounds, and is fixed in relation to, knob shaft 22. Arm 48 is attached to C-shaped body 46 in a cantilevered manner. Tab 50 is attached to arm 48.

Having arm 48 attached to C-shaped body 46 in a cantilevered manner results in a gap 56 being formed between tab 50 and knob shaft 22. Second coupler 44 is made of a plastic material such that when a sufficient force is applied to arm 48 in a direction indicated by arrow 60, arm 48 and tab 50 move in relation to C-shaped body 46. Specifically, arm 48 and tab 50 move into gap 56 toward knob shaft 22 in the direction indicated by arrow 60. Preferably, the plastic material from which second coupler 44 is made is glass fiber reinforced nylon.

Tab 50 includes a drive surface 52 and a slip surface 54. Slip surface 54 abuts arm 48 at a slip location 58. An obtuse angle 59 is defined by the slip surface 54 and the portion of the arm 48 adjacent to the slip location 58 (see FIG. 4*b*). Note that while the obtuse transition angle 59 is not a true angle (i.e. defined by two linear surfaces), the obtuse transition angle 59 approximates a true obtuse angle. Having such transition angle 59 formed so as to be obtuse facilitates slippage of the tab 50 out of the notch 36 during rotation of the second coupler 44 relative to the first coupler 30 in an inappropriate direction (i.e. as indicated by arrow 64 in FIG. 6).

Figure 5:
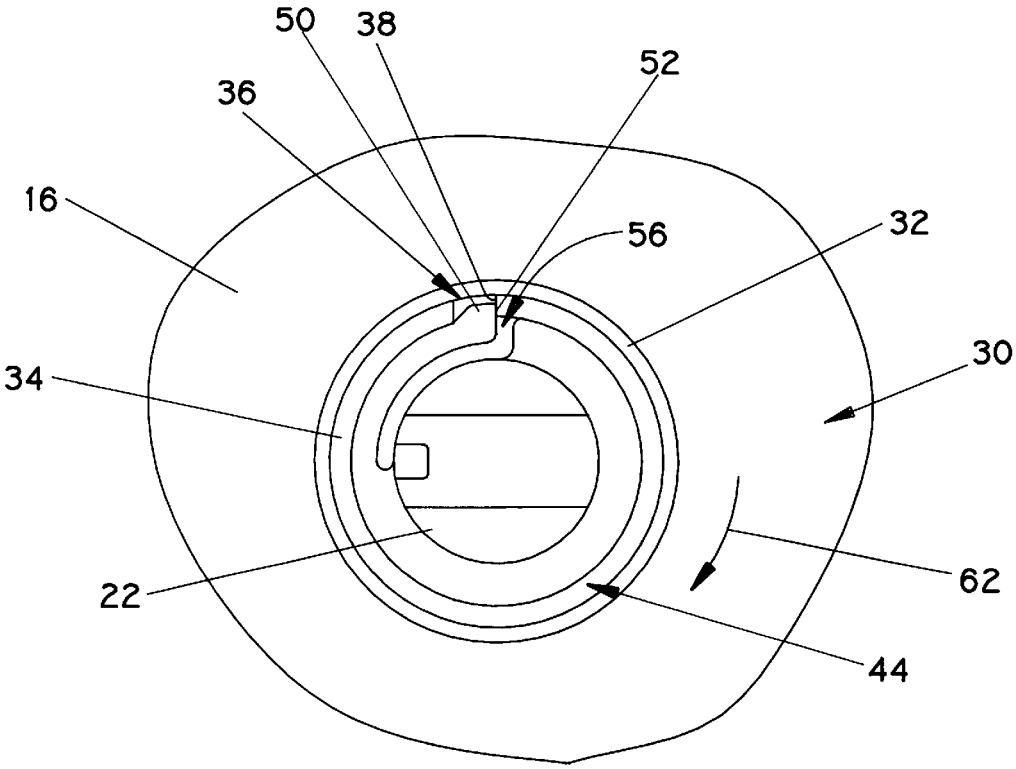
FIG. 5 is an enlarged fragmentary view of the coupling mechanism of FIG. 2, with the second coupler located at a first orientation relative to the first coupler.
Figure 6:
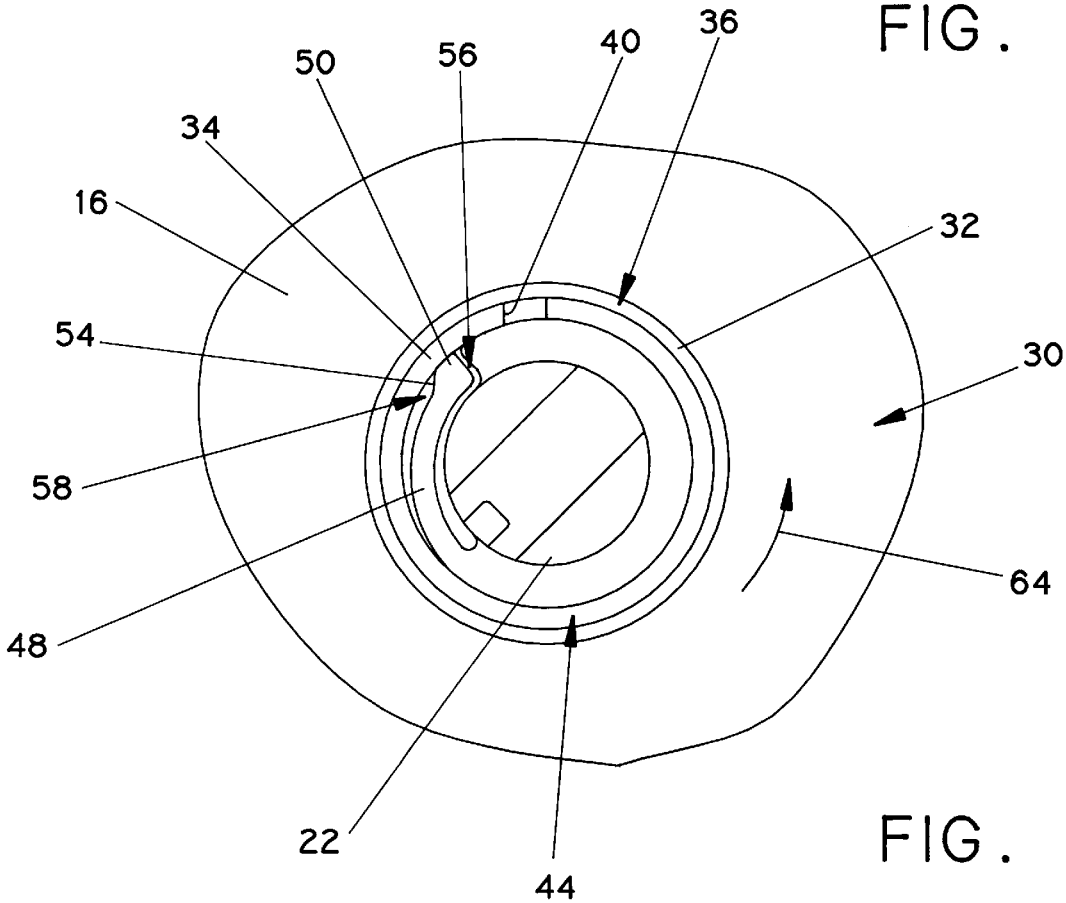
FIG. 6 is a view similar to FIG. 5, but showing the second coupler located at a second orientation relative to the first coupler.

Now referring to FIGS. 5 and 6, there is shown knob shaft 22 and second coupler 44 positioned within void 41 (see FIG. 3) of first coupler 30. FIG. 5 shows second coupler 44 located at a first orientation relative to first coupler 30. In particular, second coupler 44 is positioned within void 41 such that tab 50 is positioned within notch 36. It should be understood that when tab 50 is positioned within notch 36, gap 56 is defined between tab 50 and knob shaft 22.

Knob shaft 22 and second coupler 44 are further positioned within void 41 such that second coupler 44 contacts bearing surface 42 (note that bearing surface 42 is not visible in FIGS. 5 or 6; but see FIG. 3), and drive surface 52 contacts sidewall 38.

It should be understood that when tab 50 is positioned within notch 36 and knob shaft 22 is rotated in a direction indicated by arrow 62 (see FIG. 5), drive surface 52 is urged toward sidewall 38. When drive surface 52 is urged toward sidewall 38 first coupler 30 remains fixed in relation to second coupler 44 during rotation of knob shaft 22 since tab 50 does not slip past sidewall 38 and come out of notch 36. Therefore, knob shaft 22, second coupler 44, first coupler 30 (including inner cylindrical structure 34 and outer cylindrical structure 32) and camstack 16 all rotate together in the direction indicated by arrow 62.

Thus, it should be appreciated that rotation of a knob (not shown) secured to knob shaft 22 in the direction indicated by arrow 62 allows an operator to rotate camstack 16 in an appropriate direction to select a desired work operation of a household appliance.

However, as shown in FIG. 6, when knob shaft 22 is rotated in an inappropriate direction, i.e. in a direction indicated by arrow 64, second coupler 44 rotates to a second orientation relative to first coupler 30. At the second orientation, tab 50 is spaced apart from notch 36. Rotation of second coupler 44 in the direction indicated by arrow 64 results in second coupler 44 assuming the second orientation as a result of slip surface 54 being urged past sidewall 40. The obtuse transition angle 59 facilitates slippage of tab 50 out of the notch 36 and past sidewall 40. When the tab 50 slips out of the notch 36, the arm 48 is moved into the gap 56. With the tab 50 located out of the notch 36, knob shaft 22 and second coupler 44 are free to rotate while first coupler 30 (including inner cylindrical structure 34 and outer cylindrical structure 32) and camstack 16 remain stationary.

Thus, it should be appreciated that rotation of a knob (not shown) secured to knob shaft 22 in an inappropriate direction, as indicated by arrow 64, will not communicate any damaging force to camstack 16 regardless of how much rotational force an operator applies to the knob. In addition, it should be understood that an operator can continually rotate the knob in an inappropriate direction and tab 50 will repeatedly snap back into (and then slip past) notch 36, thus protecting camstack 16 and the knob from damage.

However, if the operator decides to rotate the knob, and therefore knob shaft 22 in the appropriate direction (i.e. the direction indicated by arrow 62 in FIG. 5), tab 50 will snap back into notch 36 and drive surface 52 will contact and be urged against side wall 38 so that camstack 16 can be rotated as described above.

Figure 7:
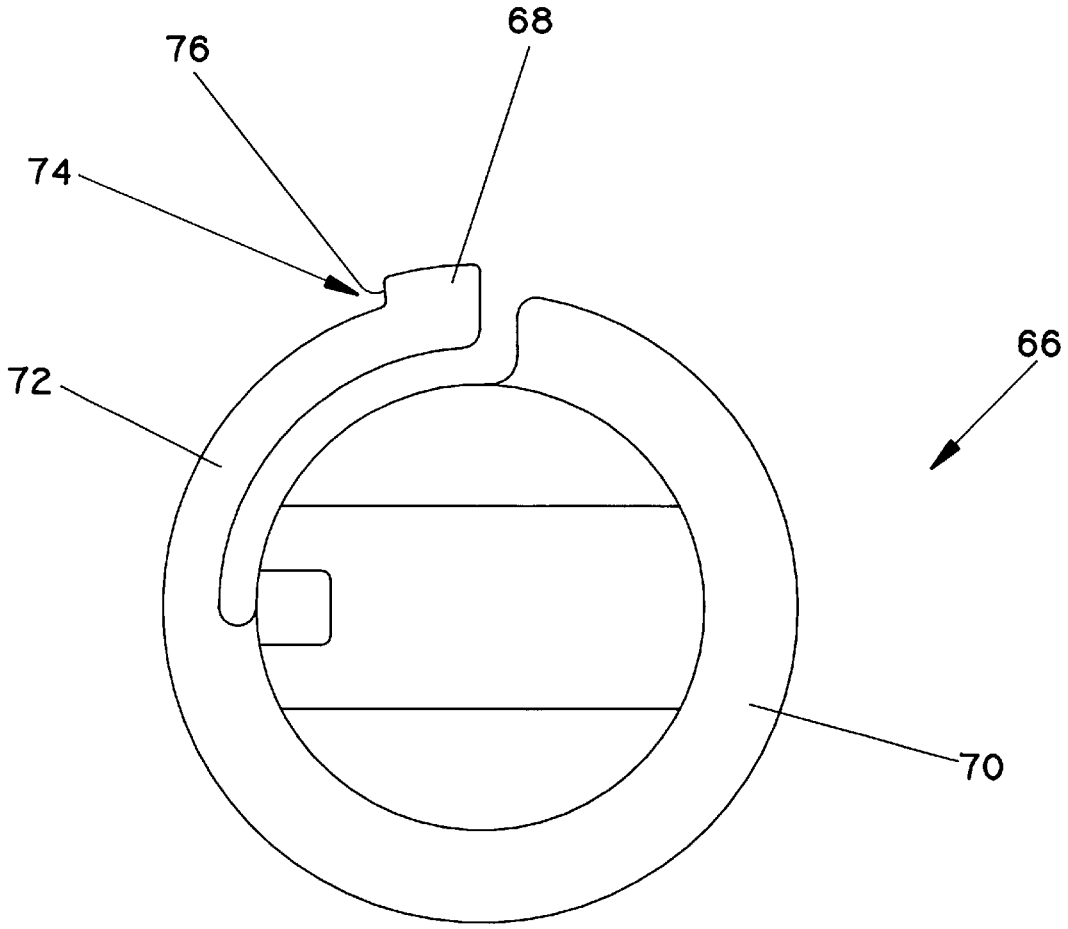
FIG. 7 is a view similar to that shown in FIG. 4, but showing an alternative embodiment of the second coupler.

While second coupler 44 is described above as having an obtuse transition angle 59, and substantial benefits are derived as a result thereof, it should be understood that other transition angles are contemplated which achieve some of the benefits of the present invention. For example, FIG. 7 shows an alternative embodiment of the second coupler. Second coupler 66 functions in a similar manner as described in reference to second coupler 44. Second coupler 66 is also constructed in much the same way as second coupler 44. For example, second coupler 66 includes a C-shaped body 70, an arm 72 attached to C-shaped body 70 in a cantilevered manner and a tab 68 attached to arm 72, wherein tab 68 has a slip surface 76. However, the transition angle defined at slip location 74 between slip surface 76 and the portion of arm 72 adjacent to slip surface 76 is an acute transition angle. Having an acute transition angle increases the force necessary to cause tab 68 to slip out of notch 36 when knob shaft 22 is rotated in an inappropriate direction as compared to when the transition angle is an obtuse transition angle.

Thus, it should be appreciated that the amount of force required to cause a tab of a second coupler to slip out of a notch of a first coupler can be manipulated by adjusting the magnitude of the transition angle. In addition, it should be understood that the force required to cause tab 50 to slip out of notch 36 when knob shaft 22 is rotated in an inappropriate direction can also be manipulated by adjusting the width 78 (see FIG. 3) of tab 50 and the corresponding length 80 of notch 36. Specifically, the greater the width 78 of tab 50 and the length of the notch 36, the greater the force required to cause tab 50 to slip out of notch 36 when knob shaft 22 is rotated in the inappropriate direction.

While the invention has been illustrated and described in detail in the drawings and foregoing description, such illustration and description is to be considered as exemplary and not restrictive in character, it being understood that only the preferred embodiments have been shown and described and that all changes and modifications that come within the spirit of the invention are desired to be protected.

What is claimed is:

1. An appliance timer, comprising:

a camstack having a program blade attached thereto;

a knob shaft; and a coupling mechanism which connects said knob shaft to said camstack, wherein said coupling mechanism provides for continuous bi-directional rotation of said knob shaft, said coupling mechanism including (1) a first coupler having a structure with a notch defined therein, and (2) a second coupler having a body and a tab which is movable in relation to said body, said tab being positionable within said notch.

2. The appliance timer of claim 1, wherein:

said second coupler further has an arm which is attached to said body, said body is fixed in relation to said knob shaft, said arm is movable in relation to said knob shaft, and said tab is attached to said arm.

3. The appliance timer of claim 2, wherein:

said structure of said first coupler has a substantially cylindrical shape defining a void therein, and said second coupler is positionable within said void.

4. The appliance timer of claim 3, wherein:

said body is C-shaped and partially surrounds said knob shaft, and said arm is attached to said C-shaped body in a cantilevered manner.

5. The appliance timer of claim 3, wherein:

said first coupler is attached to said camstack, and said second coupler is attached to said knob shaft.

6. The appliance timer of claim 3, wherein:

said first coupler defines a bearing surface located within said void, and said second coupler is in contact with said bearing surface when said second coupler is positioned within said void.

7. The appliance timer of claim 6, wherein:

said tab is positioned within said notch when (1) said second coupler is located at a first orientation relative to said first coupler, and (2) said second coupler is positioned in said void of said first coupler, and said tab is spaced apart from said notch when (1) said second coupler is located at a second orientation relative to said first coupler, and (2) said second coupler is positioned in said void of said first coupler.

8. The appliance timer of claim 7, wherein:

a gap is defined between said tab and said knob shaft when said tab is positioned within said notch, and said tab is located within said gap when said tab is spaced apart from said notch.

9. The appliance timer of claim 7, wherein:

said notch has a first sidewall and a second sidewall, said tab has a drive surface defined thereon and a slip surface defined thereon, said first coupler remains fixed in relation to said second coupler when said knob shaft is rotated in a direction such that said drive surface is urged toward said first sidewall of said notch, and said first coupler rotates relative to said second coupler when said knob shaft is rotated in a direction such that said slip surface is urged toward said second sidewall.

10. The appliance timer of claim 9, wherein:

said slip surface abuts said arm at a slip location, and said slip surface and a portion of said arm located adjacent to said slip surface define an obtuse transition angle.

11. An appliance timer, comprising:

a cam member;

a first coupler attached to said cam member, said first coupler having a structure with a notch defined therein, wherein said structure defines a substantially cylindrical member having a void defined therein;

a knob shaft; and a second coupler attached to said knob shaft and positioned within said void, wherein (1) said second coupler includes a body and a tab, (2) said tab is movable in relation to said body, (3) said body is fixed in relation to said knob shaft, and (4) said tab is positionable within said notch.

12. The appliance timer of claim 11, wherein:

said second coupler further has an arm which is attached to said body, said arm is movable in relation to said knob shaft, and said tab is attached to said arm.

13. The appliance timer of claim 12, wherein:

said body is C-shaped and partially surrounds said knob shaft, and said arm is attached to said C-shaped body in a cantilevered manner.

14. The appliance timer of claim 11, wherein:

said first coupler defines a bearing surface located within said void, and said second coupler is in contact with said bearing surface when said second coupler is positioned within said void.

15. The appliance timer of claim 11, wherein:

said tab is positioned within said notch when (1) said second coupler is located at a first orientation relative to said first coupler, and (2) said second coupler is positioned in said void of said first coupler, and said tab is spaced apart from said notch when (1) said second coupler is located at a second orientation relative to said first coupler, and (2) said second coupler is positioned in said void of said first coupler.

16. The appliance timer of claim 15, wherein:

a gap is defined between said tab and said knob shaft when said tab is positioned within said notch, and said tab is located within said notch when said tab is spaced apart from said notch.

17. The appliance timer of claim 15, wherein:

said notch has a first sidewall and a second sidewall, said tab has a drive surface defined thereon and a slip surface defined thereon, said first coupler remains fixed in relation to said second coupler when said knob shaft is rotated in a direction such that said drive surface is urged toward said first sidewall of said notch, and said first coupler rotates relative to said second coupler when said knob shaft is rotated in a direction such that said slip surface is urged toward said second sidewall.

18. The appliance timer of claim 17, wherein:

said slip surface abuts said arm at a slip location, and said slip surface and a portion of said arm located adjacent to said slip surface define an obtuse transition angle.

19. A coupling apparatus, comprising:

a first member;

a first coupler attached to said first member, said first coupler having a structure with a notch defined therein, wherein said structure defines a substantially cylindrical member having a void defined therein;

a second member; and a second coupler attached to said second member and positioned within said void, wherein (1) said second coupler includes a body and a tab, (2) said tab is movable in relation to said body, (3) said body is fixed in relation to said second member, and (4) said tab is positionable within said notch.

20. The apparatus of claim 19, wherein:

said second coupler further has an arm which is attached to said body in a cantilevered manner, said arm is movable in relation to said knob shaft, and said tab is attached to said arm.

* * * * *